United States Patent [19]

Eichelberger et al.

[11] 4,345,236

[45] Aug. 17, 1982

[54] ABRASION-RESISTANT SCREEN-PRINTED POTENTIOMETER

[75] Inventors: Charles W. Eichelberger, Schenectady; Robert J. Wojnarowski, Clifton Park, both of N.Y.

[73] Assignee: General Electric Company, Schenectady, N.Y.

[21] Appl. No.: 220,344

[22] Filed: Dec. 29, 1980

[51] Int. Cl.[3] ..... H01C 10/38

[52] U.S. Cl. ..... 338/176; 29/610 R; 338/160; 338/225; 338/308; 338/314

[58] Field of Search ..... 338/176, 158, 160, 194, 338/225, 314, 308, 309; 29/610 R

[56] References Cited

U.S. PATENT DOCUMENTS

| | | | |
|---|---|---|---|
| 2,443,018 | 6/1948 | Arvin et al. | 338/322 X |
| 3,684,998 | 8/1972 | Zablocki | 338/314 X |
| 3,830,656 | 8/1974 | Takenaka et al. | 338/309 |
| 4,243,969 | 1/1981 | Steigerwald et al. | 338/176 X |

FOREIGN PATENT DOCUMENTS

| | | | |
|---|---|---|---|
| 2726134 | 12/1978 | Fed. Rep. of Germany | 338/314 |

*Primary Examiner*—C. L. Albritton

*Attorney, Agent, or Firm*—Geoffrey H. Krauss; James C. Davis, Jr.; Marvin Snyder

[57] ABSTRACT

An abrasion-resistant screen-printed potentiometer includes top and bottom resistive layers screen-printed on a substrate. The resistivity of the top layer is substantially greater than the resistivity of the bottom layer. A slide arm is in pressure contact with the top layer and is slidably movable thereacross.

17 Claims, 4 Drawing Figures

ABRASION-RESISTANT SCREEN-PRINTED POTENTIOMETER

BACKGROUND OF THE INVENTION

The present invention is directed towards a potentiometer and, more particularly, to a novel abrasion-resistant screen-printed potentiometer, and a novel method for making the same.

In conventional systems, potentiometers are mounted as individual components on a circuitboard. That is, the potentiometer is formed as a separate component and thereafter mounted on the circuitboard. As a result, two separate hand operations are required, increasing the overall cost of the resultant circuit.

In order to reduce manual operation and thereby reduce cost, potentiometers are often screen-printed directly on the circuitboard substrate. The major problem faced when manufacturing such devices is the need to make a low-cost integral potentiometer assembly which can withstand the abrasion effect of the wiper arm over several hundred thousand cycles. To this end, the prior art screen-printed potentiometers normally use a hard-surface material for the resistive element and a relatively soft material for the wiper assembly. By spring-loading the wiper with a high degree of compliance, a large amount of wear in the wiper contact can be accommodated. The drawback of this technique is that the a wiper having a soft, highly-compliant contact assembly is of relatively high cost. High quality potentiometers which use this technique are often two to three times more expensive than comparable component potentiometers.

In an alternate technique, the resistive component of the potentiometer is constructed of a relatively soft material and the wipers are constructed of a relatively hard material, such as graphite. Graphite has a tendency to be compacted into the surface of the resistive element, thereby substantially reducing the resistance across the surface of the resistive element and changing the net resistance of the potentiometer.

In another alternative technique, the potentiometer assembly is formed using a relatively hard metallic wiper and a relatively hard-surface resistive material. In potentiometers formed by this technique the resistive material is worn away, thereby reducing the resistance in the area of wiper travel. Additionally, the use of materials having nearly equal hardness results in a potentiometer having noisy characters.

BRIEF SUMMARY OF THE INVENTION

In an effort to overcome the foregoing drawbacks of the known screen-printed potentiometers, a primary object of the present invention is to provide a potentiometer structure which has a high degree of resistance to abrasion from the wiper arm yet which permits the use of a low-cost metallic wiper.

Yet another object of the present invention is to minimize the change in resistance of the potentiometer due to wear on the resistive elements introduced by motion of the wiper across the resistive element.

Yet another object of the invention is to provide a structure which can accommodate the use of graphite-loaded polymer to achieve self-lubrication while minimizing the attendant resistance variations due to the compacting of graphite particles at the surface of the resistive member.

These and other objects of the present invention are achieved by providing a potentiometer in which a first resistive layer is formed on a substrate, with a second resistive layer being formed on the first resistive layer and having a second resistive layer resistivity substantially greater than the first resistive layer resistivity; a slide arm is placed in pressure contact with the second resistive layer and slidably movable thereacross to set potentiometer resistance.

BRIEF DESCRIPTION OF THE DRAWINGS

For the purpose of illustrating the invention, there is shown in the drawings an embodiment which is presently preferred, it being understood, however, that the invention is not limited to the precise arrangements and instrumentalities shown.

DETAILED DESCRIPTION OF THE INVENTION

Figure 1:
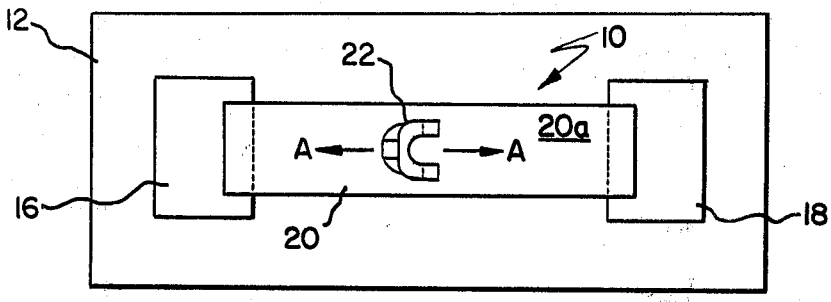
FIG. 1 is a top view of a potentiometer constructed in accordance with the principles of the present invention.
Figure 2:
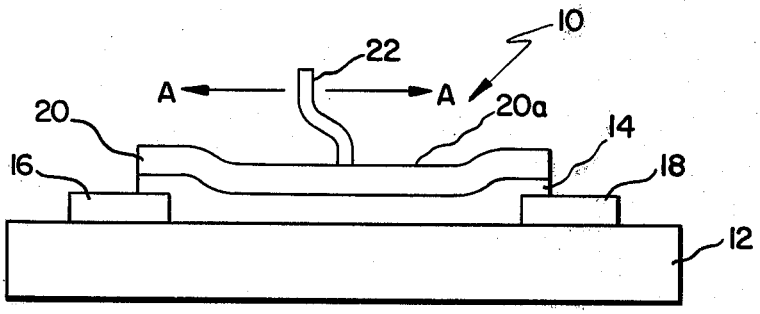
FIG. 2 is a side view of the potentiometer of FIG. 1.

Referring now to the drawings, wherein like numerals indicate like elements, there is shown in FIGS. 1 and 2 a potentiometer 10 constructed in accordance with the principles of the present invention.

Potentiometer 10 is preferably formed directly on a substrate 12 using a screen printing process. To this end, a conductive ink is deposited directly on substrate 12 in a known manner to form a bottom resistive layer 14. The layer 14 overlaps a pair of electrodes 16 and 18 previously formed on substrate 12. A second conductive ink (having a substantially greater resistivity than the ink forming layer 14) is then deposited on bottom layer 14 to form a top resistive layer 20. Typically, film thicknesses of ½ to 2 mils can be printed. The thickest possible layer 20 is normally desirable from a wear standpoint.

After the layers 14 and 20 have been formed, a wiper 22 is placed in pressure contact with the upper face 20*a* of top resistive layer 20. The wiper 22 is slidable along the length of layer 20 and is attached to a suitable guide (not shown) for this purpose.

In the embodiment illustrated, resistive layers 14 and 20 are rectangular in plan view (see FIG. 1) and wiper 22 is moved, in the direction of arrow A, linearly along the length of resistive layer 20. If desired, resistive layers 14 and 20 may be arcuate and wiper 22 may be pivoted around the axis of such arc. Other configurations are also possible as will be apparent to those of ordinary skill in the art.

Figure 4:
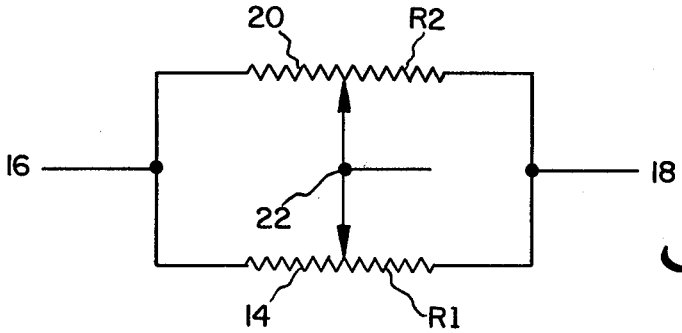
FIG. 4 is a circuit diagram of the potentiometer of FIG. 1.

In accordance with the present invention, top resistive layer 20 is formed of an abrasion-resistant material, preferably containing a lubricant (e.g., graphite), and having a resistivity substantially greater than (e.g., in the order of ten times) the resistivity of the bottom resistive layer 14. As a result, the bottom resistive layer 14 has a much greater effect on the overall resistance of the potentiometer than the top resistive layer 20. This can best be understood with reference to FIG. 4 which illustrates an equivalent circuit diagram of the potentiometer of FIG. 1. As shown in FIG. 4, the two resistive layers 14 and 20 effectively define two parallel resistors R1 and R2, respectively. Both resistors are electrically connected to wiper 22 (although wiper 22 is physically connected to resistive layer 20 only). Assuming that the resistivity of resistive layer 20 is ten times the resistivity of resistive layer 14, the total resistance of potentiometer 10 will be:

$$R_{TOTAL} = \frac{R1 \times R2}{R1 + R2} = \frac{10(R1)^2}{11R1} = 0.909R1 \quad (1)$$

As shown by the foregoing, the total resistance of potentiometer 10 will be 0.909 times the resistance of resistive layer 14. As such, relatively large changes in the resistance of resistive layer 20 will have a very minor effect on the overall resistance of the potentiometer. By way of example, a reduction in the resistance of top resistive layer 20 by fifty percent (a significant wear in layer 20) will lower the resistance of potentiometer 10 by approximately eight percent, while an increase in the resistance of top layer 20 by fifty percent will increase the overall resistance of potentiometer 10 by only four percent. Such changes in the net resistance of the potentiometer can be accommodated in most applications. Accordingly, potentiometer 10 can accommodate substantial changes in the resistance of top resistive layer 20 without significantly effecting the overall resistance of the potentiometer.

Since the potentiometer of the present invention utilizes two separate resistive layers 14 and 20, it includes an additional resistive component resulting from the flow of current from the relatively low resistivity layer 14 through the relatively high resistivity layer 20 to the wiper 22. As will be shown below, however, this resistance is small as compared to the overall resistance of potentiometer 10 and has no significant effect on the overall resistance thereof.

Figure 3:
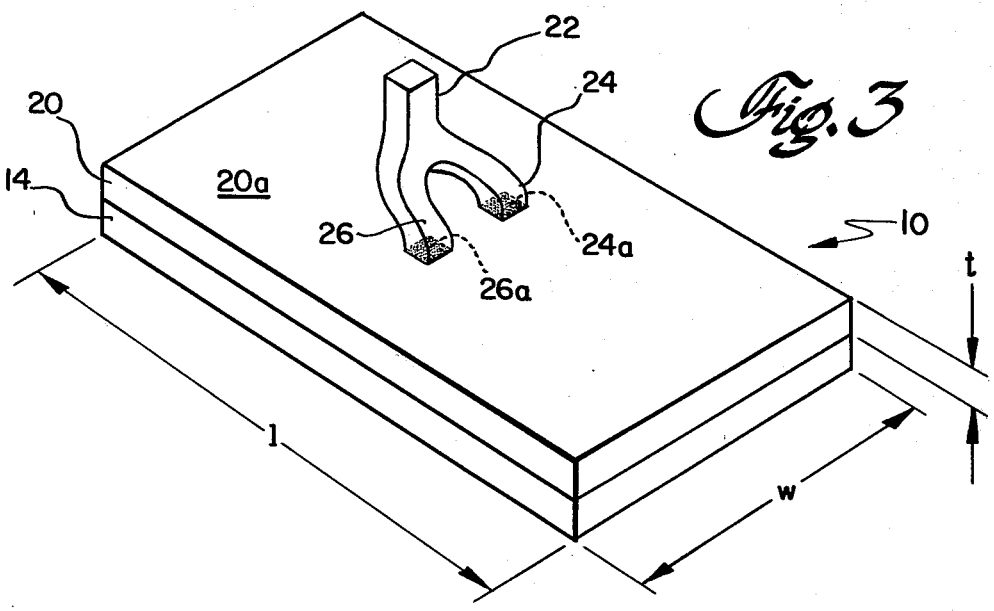
FIG. 3 is a perspective view of the resistancelayer portion of the potentiometer of FIG. 1.

In order to determine the series resistance between resistive layer 14 and wiper 20, reference should be made to FIG. 3 which illustrates a potentiometer whose top resistive layer 20 has a length l, a width w and a thickness t. In a typical application, the resistive layers may have a length l=1.5 inches, a width w=0.25 inches and a thickness t=two mils (0.002 inches). The wiper 22 typically is biforcated to form first and second wiper fingers 24 and 26 which slide across the resistive layer top face 20*a*. The contact area 24*a* and 26*a* (shaded in FIG. 3) of each finger 24 and 26 is typically 0.00125 square inches. In such a case, the series resistance between layer 14 and wiper 22 may be calculated as follows: assuming that the maximum potentiometer resistance is 10 Kohms, the resistance of top resistive layer 20 will be approximately 100 Kohms. Therefore, the resistivity of the material forming layer 20 may be computed as follows:

$$\rho = \frac{RA}{l} = \frac{100\text{K}\Omega\ (0.002\ \text{inch})\ (0.25\ \text{inch})}{1.5\ \text{inches}} \quad (2)$$

$$= 0.033\text{K ohm} \cdot \text{inch}$$

wherein R, A and l are the resistance, cross-sectional area (txw) and length, respectively, of layer 20.

The series resistance presented to the current flowing from bottom resistive layer 14 to wiper 22 can be computed as a function of the resistivity of layer 20 and the contact area of wiper fingers 24 and 26 as follows:

$$Rs = \frac{\rho t}{A'} = \frac{0.033\text{K}\Omega\ \text{inch} \times 0.002\ \text{inch}}{2 \times 0.00125\ \text{inch}^2} \quad (3)$$

$$= 0.0264\text{K ohm}$$

wherein Rs is the series resistance through layer 20, t is the thickness of layer 20 in the direction of travel of current from layer 14 to wiper 22, and A' is the area of each of wiper finger contacts 24*a* or 26*a*.

As shown by the foregoing, the series resistance in layer 12 is 0.0264 Kohm, which is relatively insignificant when compared to the 10 Kohm nominal value of the potentiometer resistance.

In the foregoing example, it has been assumed that the resistivity of top resistive layer 20 is ten times greater than the resistivity of bottom resistive layer 14. Other ratios may be used depending upon the particular application involved. Top layers with the resistivities greater than ten times the resistivity of the lower layer will be adequate for most applications.

In the preferred embodiment, top resistive layer 20 is formed of a conductive ink comprising 70 gm of 60/40 Polyester/Diethyleneglycolmonobutylether, 20 gm of graphite powder, and 10 gm of silica powder $<0.1\ \mu m$. A two mil thick layer formed of this ink will provide a high-abrasion-resistance layer having a resistivity of 10 Kohms per square inch. This ink will also insure that the top layer 20 exhibits self-lubricating characteristics due to the graphite contained therein.

The bottom resistive layer 14 may be formed of an ink composition consisting of 20 gm of 60/40 Polyester/-Diethyleneglycolmonobutylether, 40 gm of brown tungsten oxide and 40 gm of blue tungsten oxide. A one mil thick resistive layer formed of this ink will provide a stable resistive layer having a 1 Kohm per square resistivity.

The present invention may be embodied in other specific forms without departing from the spirit or essential attributes thereof and, accordingly, reference should be made to the appended claims, rather than to the foregoing specification as indicating the scope of the invention.

What is claimed is:

1. An abrasion-resistant potentiometer, comprising:

a substrate;

a first continuous resistive layer formed on said substrate and having a surface opposite to said substrate;

a second continuous and self-lubricating resistive layer formed substantially on the entire surface of said first resistive layer, the resistivity of said second resistive layer being substantially greater than the resistivity of said first resistive layer; and a slide arm in pressure contact with said second resistive layer and slidably movable thereacross.

2. An abrasion-resistant potentiometer in accordance with claim 1, wherein said second resistive layer contains graphite.

3. An abrasion-resistant potentiometer in accordance with claim 1, wherein the resistivity of said second layer is at least ten times as great as the resistivity of said first resistive layer.

4. An abrasion-resistant potentiometer in accordance with claim 1, wherein at least one of said first and second resistive layers is formed of a conductive ink.

5. An abrasion-resistant potentiometer in accordance with claim 4, wherein both of said resistive layers are formed of conductive ink.

6. An abrasion-resistant potentiometer in accordance with claim 5, wherein said second resistive layer has a thickness of ½ to 2 mils.

7. An abrasion-resistant potentiometer in accordance with claim 6, wherein said first resistive layer has a thicknesss of ½ to 2 mils.

8. An abrasion-resistant potentiometer in accordance with claim 1, wherein said second resistive layer is formed of an ink comprising: 60/40 Polyester/Diethyleneglycolmonobutylether, graphite powder and silica powder.

9. An abrasion-resistant potentiometer in accordance with claim 8, wherein said first resistive layer is formed of an ink comprising: 60/40 Polyester/Diethyleneglycolmonobutylether, brown tungsten oxide and blue tungsten oxide.

10. A process for forming an abrasion-resistant potentiometer, comprising the steps of:

providing a substrate having a surface;

forming a continuous bottom resistive layer on the substrate surface;

forming a self-lubricating, continuous top resistive layer substantially on the entire surface of the opposite side of said bottom resistive layer from said substrate, the resistivity of said top resistive layer being substantially greater than the resistivity of said bottom resistive layer; and placing a slide arm in pressure contact with a surface of said top resistive layer furthest from said substrate and in such a manner that said slide arm is slidably movable across said top resistive layer surface.

11. The process of claim 10, wherein said top resistive layer contains graphite.

12. A process according to claim 10, wherein the resistivity of said top layer is at least ten times as great as the resistivity of said bottom layer.

13. A process according to claim 10, wherein said step of forming said bottom resistive layer includes the step of depositing a conductive ink on said substrate surface, and wherein said step of forming said top resistive layer includes the step of depositing a conductive ink on said bottom resistive layer surface.

14. A process according to claim 13, wherein said top resistive layer has a thickness of ½ to 2 mils.

15. A process according to claim 14, wherein said bottom resistive layer has a thickness of ½ to 2 mils.

16. A process according to claim 10, wherein said step of forming said top resistive layer on said bottom resistive layer surface comprises the step of depositing a conductive ink including 60/40 Polyester/Diethyleneglycolmonobutylether, graphite powder and silica powder on said bottom resistive layer.

17. A process according to claim 16, wherein said step of forming said bottom resistive layer on said substrate surface comprises the step of depositing a conductive ink comprising 60/40 Polyester/Diethyleneglycolmonobutylether, brown tungsten oxide and blue tungsten oxide on said substrate surface.

* * * * *